United States Patent [19]

Mangini et al.

[11] 3,954,219

[45] May 4, 1976

[54] PACKAGING

[75] Inventors: Daniel J. Mangini, Turnersville; William J. Mauthe, Cinnaminson, both of N.J.

[73] Assignee: Glenco Refrigeration Corporation, Philadelphia, Pa.

[22] Filed: Nov. 12, 1974

[21] Appl. No.: 523,048

[52] U.S. Cl. ..... 229/23 A; 206/386; 229/47

[51] Int. Cl.[2] ..... B65D 5/35; B65D 45/26

[58] Field of Search ..... 229/5.7, 23 R, 23 A, 229/47; 206/386

[56] References Cited

UNITED STATES PATENTS

| | | | |
|---|---|---|---|
| 1,119,165 | 12/1914 | Hummel | 229/47 |
| 1,690,851 | 11/1928 | Behrman | 229/23 R X |
| 1,690,853 | 11/1928 | Behrman | 229/47 |
| 2,718,996 | 9/1955 | Jamieson | 229/23 A |
| 2,818,972 | 1/1958 | Claus | 206/386 |
| 2,819,009 | 1/1958 | David, Jr. | 229/47 |
| 2,962,159 | 11/1960 | Sheard | 229/47 UX |
| 3,012,660 | 12/1961 | Sheldon, Jr. | 206/386 X |
| 3,487,914 | 1/1970 | Weaver et al. | 229/23 R X |

FOREIGN PATENTS OR APPLICATIONS

| | | | |
|---|---|---|---|
| 1,021,785 | 12/1957 | Germany | 229/47 |

*Primary Examiner*—William Price
*Assistant Examiner*—Stephen Marcus
*Attorney, Agent, or Firm*—Charles A. McClure

[57] ABSTRACT

A packaging container is made from folding blanks of corrugated board or similarly suitable material in the form of a hollow body with at least one end covered by an overlapping end cap secured by circumferential handling of the end cap and clips extending from the container interior through registering openings in the body and end cap and engaged by the band.

12 Claims, 10 Drawing Figures

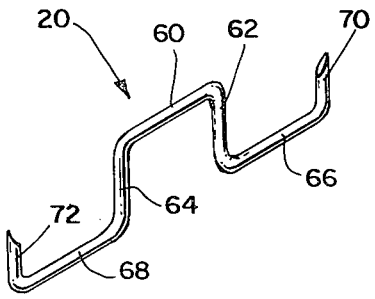
FIG. 4
FIG. 3
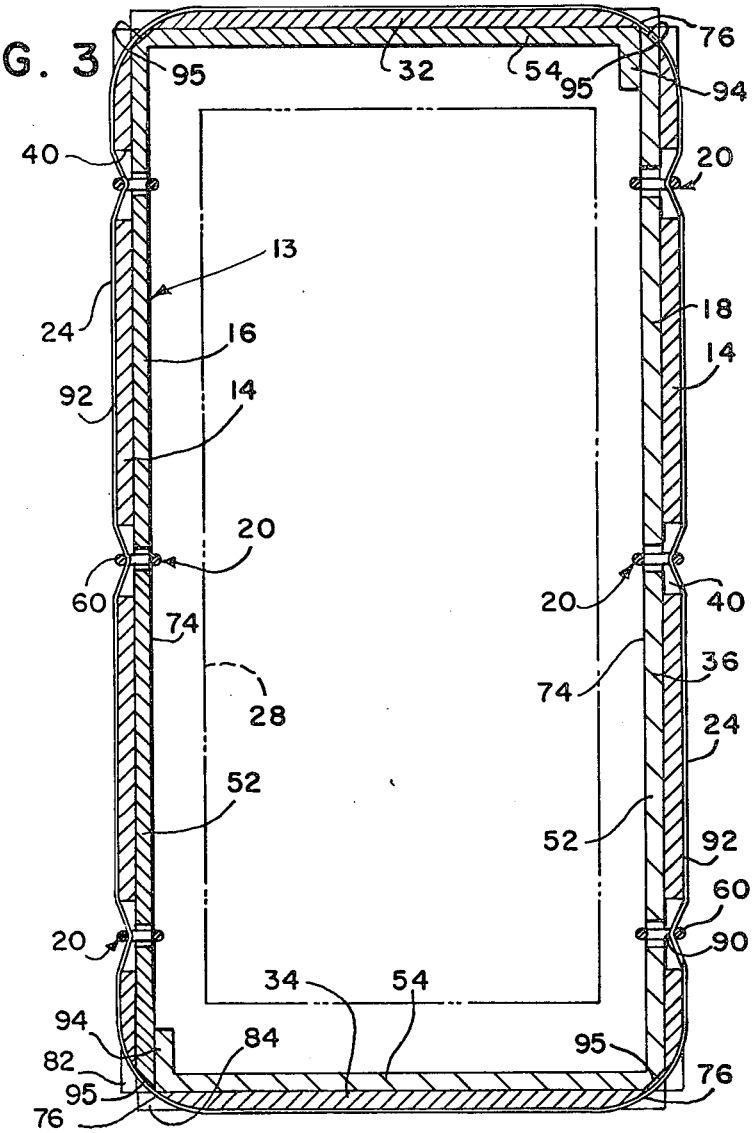
FIG. 2
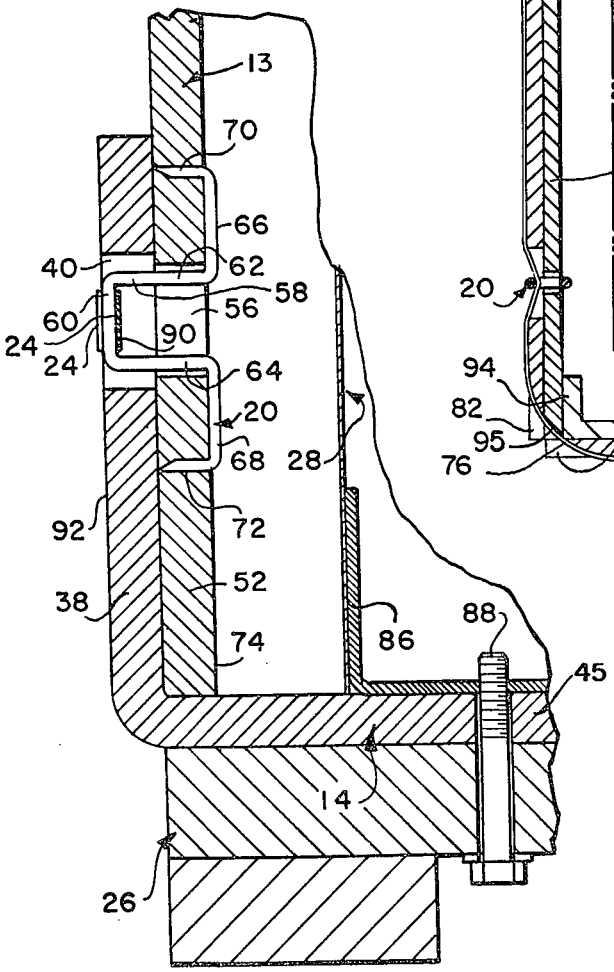
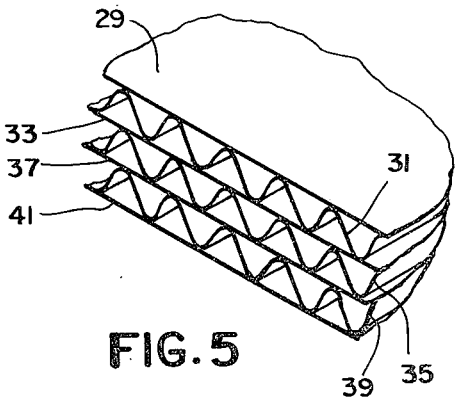
FIG. 5

PACKAGING

This invention relates to packaging of bulky or heavy items for shipment, utilizing folding blanks of packaging material, such as multi-ply corrugated board, together with means for securing the blanks together in container form.

Conventional crating of items for shipment has become progressively more expensive for shippers and less protective of the contents as crating boards have increased in cost and decreased in quality and as stapling has replaced nailing as the principal fastening technique. Attempts at substitution of materials have resulted in inferior containers or even higher costs, and there is a critical need for a crating type of packaging that is economical of both materials and labor and that safeguards the packaged contents with a high degree of security.

A primary object of the present invention is formation of a novel and useful container especially suited to packaging items that are bulky or heavy or both.

Another object is adaptation of readily available packaging materials to formation of such a container.

A further object is saving in the cost of such packaging materials and in the expense of forming them into such a container.

Yet another object is provision of such a container designed to safeguard its contents securely.

Other objects of the present invention, together with means and methods for attaining the various objects, will be apparent from the following description and the accompanying diagrams of a particular embodiment of the invention, which is presented by way of illustration rather than limitation.

FIG. 2 is a fragmentary sectional elevation, taken at 2—2 on the preceding view, showing side and bottom parts of the container on an enlarged scale;

FIG. 3 is a sectional plan, taken at 3—3 on FIG. 1, on a scale intermediate between the scales of the respective preceding views;

FIG. 4 is a perspective view of a clip useful in banding a container according to this invention; and FIG. 5 is a fragmentary sectional perspective view of a multi-ply corrugated construction suitable for component materials of such container.

In general, the objects of the present invention are accomplished in a packaging container having as one component a hollow open-ended body for surrounding contents to be packaged and as another component a separately formed end cap adapted to cover and partly overlap an open end of the body. A plurality of openings aligned in the body and a like plurality of openings aligned in the end cap are adapted to register with one another in assembly of the container. A like plurality of banding clips having ends retainable within the body and having band-receiving webs insertable through the registered openings are adapted to receive a band extending circumferentially around the end cap to secure it and the body together.

The invention extends also to packaging blanks foldable to make up such a container, and to methods of adapting them thereto and forming the container therefrom.

Figure 1:
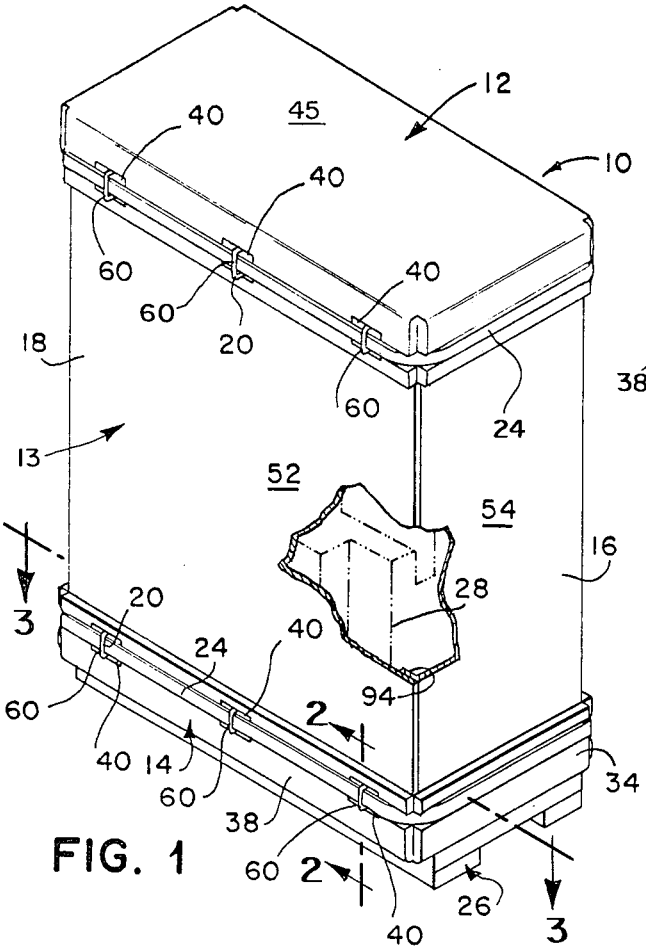
FIG. 1 is a perspective view of a packaging container, according to this invention, assembled about an item of contents and partly broken away to reveal the interior.

FIG. 1 shows container 10 of this invention partly cut away to show an item of contents 28 (indicated by broken lines) in the interior. Major components of the container include top end cap 12 and bottom end cap 14 juxtaposed to the corresponding ends (otherwise open) of container body 13. The body is rectangular in plan and has pair of narrow sidewalls 16 and pair of wide sidewalls 18 (only one each visible here). Clips 20, each with band-receiving web 60, are visible in openings 40 in the end caps: three such openings being aligned with one another parallel to but spaced from the visible long edge of each of the end caps. Band 24 extends circumferentially about top cap 12 and within web 60 of each of clips 20,-and another band 24 does likewise on bottom cap 14, each of the bands compressing the container material at the corners about which it extends, as shown more fully in subsequent views.

FIGS. 2 and 3 show the same container sectioned in elevation (fragmentary) and in plan, respectively, taken as indicated on FIG. 1. Prominent in FIG. 2 is mounting bolt 88 threaded into corner piece 86 of item of contents 28 after passing through a cross-member of skid 26 and pad 45 of bottom end cap 14. Although not shown, similar bolts are similarly engaged at the other bottom corners, thereby securing the container and its contents to the skid. Opening 40 in upturned flap 38 of the bottom end cap registers with opening 56 in sidewall 52 of body 13, and clip 20 extends within the registered openings. The clip is generally W-shaped, with each of the three apexes of the W broadened and flattened, instead of pointed, and with both intervening portions 62 and 64 thereof rendered substantially parallel to one another. When assembled to the container as shown, such portions 62 and 64 are substantially perpendicular to adjacent interior and exterior faces 74 and 92 of the container and to band 24, which extends circumferentially about the exterior face of the bottom end cap. Broadened interior apex portions 66 and 68 of the clip are shown contiguous with the interior face of the body, while exterior broadened centermost portion or web 60 of the clip has its inner or band-receiving surface recessed within opening 40 so that band 24 is deflected out of its regular plane tangential to the exterior surface of the end cap to pass within the clip web. Ends 70 and 72 of clip 20 are pointed and are shown inserted into sidewall panel 52 of the body, piercing the interior face but not the exterior face thereof. The clip is shown in perspective in FIG. 4.

FIG. 3 shows that openings 56 in body sidewall panel 52 are narrow laterally than are openings 40 in the upturned flaps of the bottom end cap. The narrowness of openings 56 aids in orienting clips 20 as just mentioned, while the relatively broader openings 40 in the end cap enable band 24 to be deflected out of the exterior tangential plane at a relatively mild angle to pass within the clip webs and to form an included angle no larger than about sixty degrees therewithin.

Also indicated in FIG. 3 is the compression of corner 95 of the container by curved corner bights 76 of band 24, tightened therearound, exposing shoulders 82 and 84 in respective flaps 38 and 34 of the bottom end cap. This aspect of the invention is illustrated further in subsequent views and is described more fully in corresponding description hereinafter. A sturdy but suitably compressible component material, three-ply corrugated board, is shown in transverse section in FIG. 5, comprising opposite facing layers 29 and 41 and internal layers 33 and 37 of paper spaced apart by intervening centermost corrugation layer 35 and flanking corrugation layers 31 and 39.

FIG. 3 also illustrates the formation of body 13 of the container, with pair of mutually opposing wide sidewall panels 52 joined at vertical corner folds to pair of mutually opposing narrow sidewall panels 54, each of the latter also being joined at vertical corner folds to a lap panel 94 secured to an inner marginal portion of the other wide sidewall panel along a vertical corner fold. Foldable packaging blanks adapted to form the body and end caps are shown in the next two views.

Figure 6:
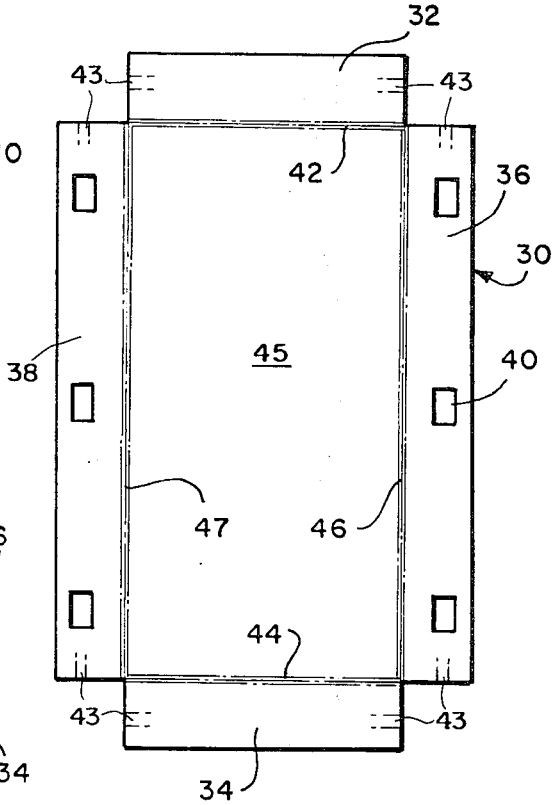
FIG. 6 is a flat view of a form of packaging blank adapted for folding to form an end cap of a container according to the present invention.
Figure 7:
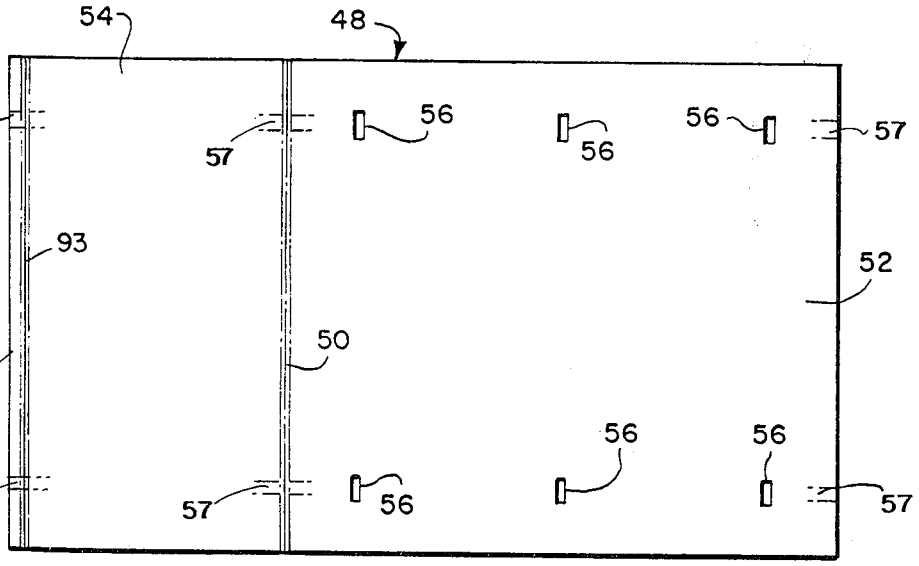
FIG. 7 is a flat view of a form of packaging blank adapted for folding to form the body of such container.

FIGS. 6 and 7 show, respectively, end cap packaging blank 30 and body packaging blank 48 useful in forming the container already illustrated. Because of space limitations in the drawing the blanks are not shown oriented relative to one another as they would be for assembly, but the assembly orientation is readily visualizable, especially in the light of the following description.

End cap blank 30 comprises rectangular central portion or pad 45 to which are joined narrow flaps 32 and 34 and wide flaps 36 and 38 along respective fold lines 42, 44, 46, and 47. The outermost edges of the various flaps are substantially equidistant from their respective fold lines. Each of the two wide flaps has three evenly spaced rectangular openings 40 therethrough aligned with one another along but spaced from the outermost edge. The openings are identical and are longer in the direction parallel to the fold line and the outermost edge, which becomes the circumferential banding direction in assembly of the container, than they are perpendicular thereto.

Body blank 48 comprises wide sidewall panel 52 and narrow sidewall panel 54 joined along fold line 50 as well as very narrow lap panel 94 joined to the narrow panel along fold line 93. Two such blanks go to make up the body of the container by having the lap panel of each secured to a marginal portion of the wide sidewall panel of the other as shown already in FIG. 3. The upper and lower edges of wide sidewall panel 52 have three evenly spaced rectangular openings 56 therethrough aligned with one another along but spaced from the edge. The openings are identical and are shorter in the direction parallel to the edge, which becomes the circumferential direction in banding of the container, than they are perpendicular thereto.

Both the end cap and body blanks have narrowly spaced pairs of broken lines 43 marking areas thereof subject to compressive distortion in banding of the container. In the end cap blank such pairs are found on the wide flap at the opposite edges in alignment with row of openings 40, being spaced more narrowly than the narrow dimensions of the openings. The narrow flaps of the end cap blank are marked similarly at their respective opposite edges, which are adapted to fold down in assembly and be juxtaposed to and register with the similarly marked edges of the wide flaps. In each body blank corresponding pairs of marks 57 outlining compressive distortion areas are found at the wide panel edge in alignment with each row of openings 56. Similar pairs of marking lines cross fold lines 50 and 93 in line with the openings but narrower in extent than the wide dimension of the openings.

Both end cap and body blanks 30 and 48 are either preslit along respective pairs of lines 43 and 57, as in die cutting of the blanks, or are slit during assembly as shown in subsequent views. In either event the slitting of an end cap blank preferably extends completely through the blank from face to face, but the slitting of a body blank preferably stops short of the face that becomes the interior wall of the container.

The body of the container of formed in obvious manner from two body blanks 48 by securing lap panel 94 of each to a corresponding marginal portion of wide sidewall panel 52 of the other, preferably adhesively, after folding thereof along fold line 93 and along fold line 50 as well. The result is a hollow cylindrical body (rectangular in cross-section) open at both top and bottom.

Formation of an end cap blank into an end cap for the body can be visualized equally readily. Pad 45 of end cap blank 30 is juxtaposed to one of the open ends of the body to cover it, and the flaps of the blank are folded against the corresponding sidewalls of the body. Such folding of flaps 36 and 38 adjacent opposite wide sidewalls 52 brings openings 40 in the flaps into register with openings 56 in the sidewalls, as already shown in FIGS. 2 and 3. One of clips is inserted in each such set of registered openings, with web 60 of the clip protruding toward the exterior and pointed ends 70, 72 pressed into interior surface 74 of the sidewall to retain the clip in place. Band 24 of strapping material (usually metal) is passed circumferentially about the end cap and body, being inserted within the web of each clip before being tightened.

Figure 8:
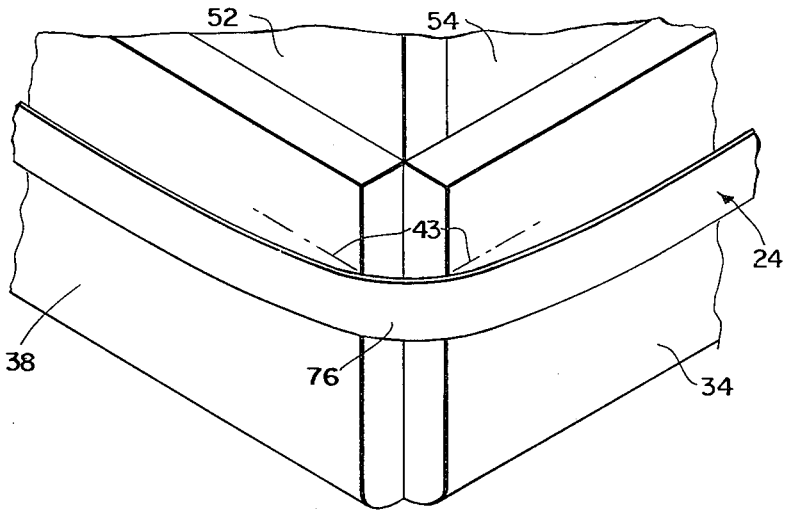
FIG. 8 is a perspective view, considerably enlarged, of a bottom corner of such container at an early stage in the securing of it onto the body, showing a circumferential band before being tightened thereon.

FIG. 8 shows a bottom corner of the container at such stage in assembly. Band 24 extends in smoothly curved corner bight 76 about the vertical junction of sidewalls 52 and 54 and covering flaps 38 and 34. If the blanks have not been preslit alongside the band location, as at marks 43 (only the upper one in each spaced pair being visible) they are slitted now as shown in the next view.

Figure 9:
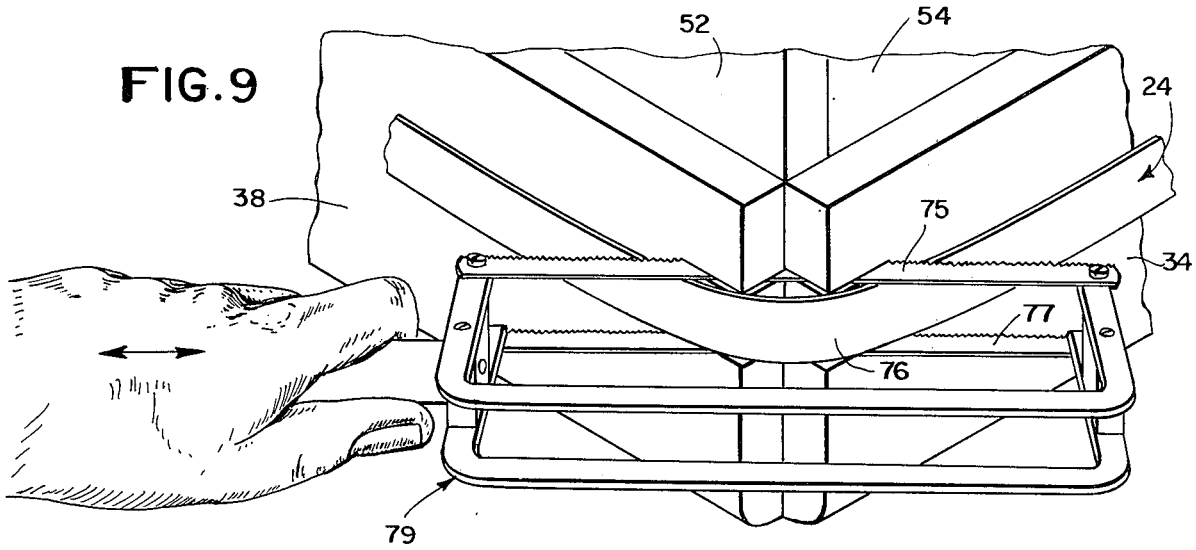
FIG. 9 is a similar view of the same corner at a later stage, showing slitting of the container corner along opposite side edges of the band.

FIG. 9 shows the same corner of the container just shown but with the addition of double-bladed hacksaw 79 fitting along both sides of the band at the corner junction and moving to and fro as indicated by a double arrow superimposed on the hand holding the hacksaw handle. Upper blade 75 and lower blade 77 closely flank corner bight 76 of band 24 and form a corresponding pair of slits in the end cap and the underlying body material. At their greatest extent the slits preferably extend completely through the edge portions of the end cap but not completely through the body to the interior of the container. Such slitting procedure is repeated at all four corners, whereupon the hacksaw is removed and the band is tightened.

Figure 10:
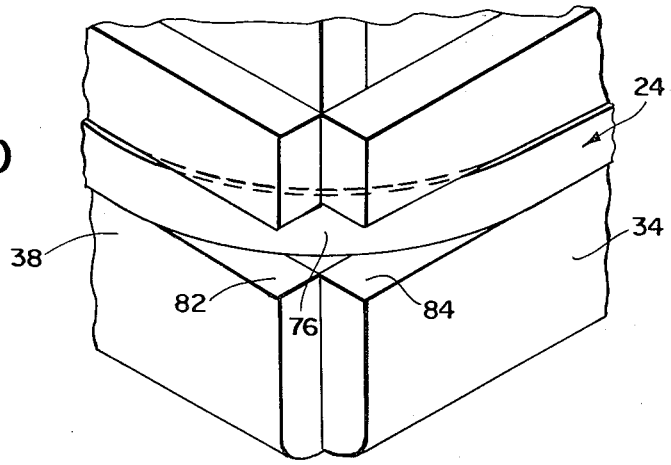
FIG. 10 is a like view of the same corner at a subsequent time, after tightening of the band.

FIG. 10 shows the appearance of the same container corner after tightening of band 24. If the blanks were preslit, the step of FIG. 9 may be omitted, and assembly would proceed directly to the present view from FIG. 8. Corner bight 76 of the band has compressed the underlying portion of the container sufficiently to distort it inwardly, as permitted by the slitting and the compressible nature of the container material. Resultant recessing of the corner bight relative to the exterior surface of the container exposes shoulders 82 and 84 on respective end cap flaps 38 and 34 and, of course, corresponding oppositely directed configurations thereabove not visible in this view. The resulting interlocking construction secures the end cap to the body, until the band is removed for unpacking of the contents.

A like corner is shown on a smaller scale in the overall view of FIG. 1, which also includes optional skid 26. Formation of the top end cap shown there is like formation of the bottom end cap except for the obvious downward instead of upward folding of the end cap flaps. The banded sides of the container are maintained relatively bulge-free, despite tightening of the band, by reason of the inward deflection of the band about the webs of clips 20, as shown most clearly in the cross-sectional views, FIGS. 2 and 3.

It will be apparent that a top end cap may be assembled to a container body according to this invention to provide a shell open only at the bottom end. Such shell (not shown) may be lowered around an item to be packaged, resting on a skid with a bottom end cap blank therebetween as shown fragmentarily in FIG. 2.

The body itself may be formed of two like body blanks, as already shown and described, or from a single blank having two narrow and two wide panels (alternately spaced) and a single lap panel, or may even be formed otherwise so as to be equivalent thereto in use according to this invention.

If desired, the container may be provided with an alternative closure at either the top or the bottom. Nor need it be rectangular in plan; it could have more sides and have, for example, a hexagonal section—or perhaps one fewer sides and be triangular in section.

In any event this invention provides a container construction that is secure, lightweight, easy to assemble and disassemble, and highly economical. The nature and extent of its advantages and benefits will become most apparent to those who undertake to use it.

Notwithstanding the illustration and description of a certain embodiment of this invention, some modifications have been suggested. Other variations could be made, as by adding, combining or subdividing parts or steps, or substituting equivalents, while maintaining at least some of the advantages and benefits of the invention, which itself is defined in the following claims.

The claimed invention:

1. In a packaging container having as major components a hollow open-ended body for surrounding contents to be packaged and at least one separately formed end cap adapted to cover and partly overlap an open end of the body, including a plurality of openings through the body and a like plurality of openings through the end cap, the openings in each of such components being aligned with one another and in the respective components being adapted to register in assembly of the container, the improvement comprising a like plurality of banding clips having ends retainable within the body and having band-receiving webs insertable through the registered openings, and a circumferential band adapted to extend within the webs and around the container to secure the body and end cap together, wherein the webs of the banding clips are recessed relative to the adjacent exterior surface of the end cap, when assembled, and thereby deflect the band, wherever it extends therewithin, from the plane of such exterior surface toward the interior of the container.

2. Container according to claim 1, wherein in the circumferential direction the openings in the body are narrow to localize the clips, and the openings in the end cap are wide, relative thereto, to accommodate the deflected parts of the band.

3. Container according to claim 1, wherein the banding clips have their ends pointed and back-curved essentially perpendicular to the web to be retained by piercing the inside surface of the body.

4. In a packaging container having as major components a hollow open-ended body for surrounding contents to be packaged and at least one separately formed end cap adapted to cover and partly overlap an open end of the body, including a plurality of openings through the body and a like plurality of openings through the end cap, the openings in each of such components being aligned with one another and in the respective components being adapted to register in assembly of the container, a like plurality of banding clips having ends retainable within the body and having band-receiving webs insertable through the registered openings, and a circumferential band adapted to extend within the webs and around the container to secure the body and end cap together, improved external corners at the junction of adjacent sides about which the band bends, the container material having therein a pair of slits flanking the contact location of the band with the material, the material between the slits being adapted to be compressively distorted relative to the adjacent material surface upon tightening of the band thereon, wherein the flanking slits extend through the end cap at the corners and into the underlying portion of the body.

5. Container according to claim 4, wherein the slits in the underlying portion of the body extend into the exterior surface thereof but not through the interior surface thereof.

6. In a packaging container made of compressible material and having an open-ended body portion and an end cap juxtaposed thereto closing an open end of the body and overlapping part of the body, and having means associated therewith for securing the end cap on the body including means for retaining a band circumferentially about the overlapped end cap and body portions, whereupon tightening of the band thereonto compresses the underlying cap material and depresses it relative to the surface of adjacent cap material, thereby securing the end cap onto the body, improved means for retaining the band comprising generally W-shaped clips with each apex portion broadened, rather than pointed, thereby rendering the intervening portions substantially parallel to one another and enabling the band to pass under the broadened centermost part or web or each such clip, each such clip fitting through registering openings in the overlapped end cap and body with its web oriented toward the exterior and with its ends inserted into the inner wall of the body.

7. Packaging container according to claim 6, wherein each clip is installed substantially perpendicular to the plane of the adjacent band along the adjacent outer surface of the container, but wherein the web of the clip is recessed relative to the outer surface of the container, whereupon the band is deflected out of such plane and toward the container interior sufficiently to pass under such web.

8. Packaging container according to claim 6, wherein the openings in the body are slotlike and fit closely about the clips and thereby assist in orienting the clips substantially perpendicular to such plane.

9. Foldable packaging blanks for use in forming the container of claim 6, comprising at least one body blank and at least one end cap blank, the respective blanks having therein aligned openings adapted to register with one another upon folding of the blanks and assembly of the container therefrom.

10. Foldable packaging body and end cap blanks for use in forming a container having a multi-sided body with at least one of its ends closed by an end cap covering it and partly overlapping the circumferential edge thereof, each of the blanks having a plurality of openings therein aligned with one another along an edge thereof but spaced therefrom, openings in the respective blanks being adapted to register with one another upon folding of the blanks and assembly thereof into container form, the end cap blank having edge portions aligned with the aligned openings therein and adapted to be depressed relative to adjacent parts of the blanks, and the body having fold and edge portions aligned with the aligned openings therein and adapted to be depressed relative to adjacent parts of that blank, upon compressive banding when in container form wherein such depressible portions of the respective blanks have slits therein spaced apart by at least the banding width and parallel to the direction of alignment.

11. Packaging blanks according to claim 10, wherein the slits in the end cap blank extend through it from face to face but wherein the slits in the body blank extend through its outer face but stop short of its inner face.

12. Foldable packaging body and end cap blanks for use in forming a container having a multi-sided body with at least one of its ends closed by an end cap covering it and partly overlapping the circumferential edge thereof, each of the blanks having a plurality of openings therein aligned with one another along an edge thereof but spaced therefrom, openings in the respective blanks being adapted to register with one another upon folding of the blanks and assembly thereof into container form, the openings in the body blank being longer in the end-to-end direction than in the direction transverse thereto, the openings in the end cap blank being substantially the same length in the end-to-end direction as those in the body blank but being narrower in that direction than in the direction transverse thereto, the end cap blank having edge portions aligned with the aligned openings therein and adapted to be depressed relative to adjacent parts of the blank, and the body blank having fold and edge portions aligned with the aligned openings therein and adapted to be depressed relative to adjacent parts of that blank, upon compressive banding when in container form, wherein such depressible portions of the respective blanks have slits therein spaced apart by at least the banding width and parallel to the direction of alignment.

* * * * *